US006585604B1

(12) United States Patent
Morrone

(10) Patent No.: US 6,585,604 B1
(45) Date of Patent: Jul. 1, 2003

(54) SWING THING

(75) Inventor: Rudolph Domnic Morrone, Cherry Hill, NJ (US)

(73) Assignee: Rudolph D. Morrone, Cherry Hill, NJ (US)

( * ) Notice: Subject to any disclaimer, the term of this patent is extended or adjusted under 35 U.S.C. 154(b) by 0 days.

(21) Appl. No.: 09/547,145

(22) Filed: Apr. 11, 2000

Related U.S. Application Data

(60) Provisional application No. 60/129,921, filed on Apr. 19, 1999.

(51) Int. Cl.[7] ..... A63B 53/06; A63B 53/16; A63B 69/36; A63B 57/00

(52) U.S. Cl. ..... 473/237; 473/278

(58) Field of Search ..... 473/263, 278, 473/233, 237

(56) References Cited

U.S. PATENT DOCUMENTS 1,248,826 A * 12/1917 Kaiser ..... 473/278
1,790,762 A * 2/1931 Page ..... 473/278
1,980,701 A * 11/1934 Rosengarten ..... 473/278
2,124,123 A * 7/1938 Rosengarten ..... 473/278
3,037,778 A * 6/1962 Chedister et al. ..... 473/233
3,081,091 A * 3/1963 Grow ..... 473/237
5,451,059 A * 9/1995 Weis ..... 473/278
5,620,376 A * 4/1997 Hsu ..... 473/233

* cited by examiner

*Primary Examiner*—Paul T. Sewell
*Assistant Examiner*—Alvin A. Hunter, Jr.

(57) ABSTRACT

This invention is for someone who wants to exercise, self-teach or teach the golf swing. The object is to make contact with the "sweet spot" portion center of the club head. Using this will tone the rhythm of his or her body to a consistent swing posture. The results will lead to straighter, longer drives. This unit can be used as a warm up prior to the golf course or driving range. What helps make this a reality is the ball will project a material that will leave a mark on the club head, indicating the area of impact. This will be wiped away before each swing. The user can adjust standing spot or hands or what they feel was the reason for not making contact in the sweet spot. Once you show a person how to hold the club, they can swing at this flowable ball and your lesson to them has begun. When they can become somewhat consistent at making contact, going to the driving range is there next step. After someone takes a lesson, they may want this invention to use at home to practice. You would need a big back yard just a safe spot where one is able to swing a golf club. The city people will welcome this invention as their space is very limited. The amount of ball exposed to user can be adjusted with the use of the removable rubber mats.

4 Claims, 14 Drawing Sheets

BALL UNIT AND MAT SIDE VIEW

BALL UNIT AND MAT SIDE VIEW

SIDE VIEW OF BALL UNIT AND MAT

FRONT VIEW OF BALL UNIT

BACK VIEW OF BALL UNIT

TOP VIEW

BOTTOM VIEW OF BALL ASSEMBLY WITHOUT PLUG

BOTTOM VIEW OF BALL ASSEMBLY WITH PLUG

1ST ALTERNATE VERSION
SIDE VIEW
WITH FIVE RUBBER MATS

SIDE VIEW - WITH FOUR RUBBER MATS

SIDE VIEW-WITH THREE RUBBER MATS

SIDE VIEW WITH TWO RUBBER MATS

SIDE VIEW-WITH ONE RUBBER MAT

SIDE VIEW-WITH NO RUBBER MAT

2ND ALTERNATE VERSION

BACK VIEW

FRONT VIEW OF BALL HOLDER AND PAD

SWING THING

This application claims the benefit of Provisional application No. 60/129,921; Filing date Apr. 19, 1999.

BACKGROUND OF THE INVENITON

This invention is a self-teaching and teaching device for the golf swing. It is also a practice device for the swing. It can be used indoors and outdoors with an assuring degree of safety. There is not a flying golf ball with this. The ball struck is of a flexible material that is held down by a hitting mat made of astro turf or any material compatible to it. The ball section with the stem and pad sections is all molded together into one piece or unit. The pad section is where it is bolted to the mat section. Th two together keep it on the ground and stable. It takes two nuts and bolts about five inches apart and centralized. The objects of this invention is to self-teach or teach a new or old golfer to make contact with our ball section at the middle of the club face for longer and straighter drives. Another advantage is it will tone the body muscles and result in a consistent swing. The guide to his consistency is that when the force, slight or great, will allow for the ball section to eject a material that will mark the face of the golf club. This tells the golfer where he hit ball. The golfer wants to make contact in the "sweet spot" or center of the club face. His goal will be to maintain his swing so that this is accomplished. They have failed to solve the problem of hitting a golf ball without using a golf course or range. Now you can hit this flexible golf ball and virtually get the same satisfaction as hitting a real golf ball. Plus you will see where on the golf club head you made contact.

BRIEF SUMMARY OF THE INVENTION

This invention is for someone who wants to exercise, self-teach or teach the golf swing. The object is to make contact with the "sweet spot" portion center of the club head. Using this will tone the rhythm of his or her body to a consistent swing posture. The results will lead to straighter, longer drives. This unit can be used as a warm up prior to the golf course or driving range. What helps make this a reality is the ball will project a material that will leave a mark on the club head, indicating the area of impact. This will be wiped away before each swing. The user can adjust standing spot or hands or what they feel was the reason for not making contact in the sweet spot. Once you show a person how to hold the club, they can swing at this flowable ball and your lesson to them has begun. When they can become somewhat consistent at making contact, going to the driving range is their next step. After someone takes a lesson, they may want this invention to use at home to practice. You would need a big back yard just a safe spot where one is able to swing a golf club. The city people will welcome this invention as their space is very limited. The amount of ball exposed to user can be adjusted with the use of the removable rubber mats. With the mechanical version, you can raise or lower the ball/stem section by removing the nut and bolt. Place the unit to a desired amount of exposure of ball/stem. Secure with nut and bolt.

BRIEF DESCRIPTION OF THE DRAWINGS

FIG. 8-1—Is the same as FIG. 8 but with one rubber mat removed and four in place.

FIG. 8-2—Is the same as FIG. 8 but with two rubber mats removed and three in place.

FIG. 8-3—Is the same as FIG. 8 but with three rubber mats removed and two in place.

FIG. 8-4—Is the same as FIG. 8 but with 4 rubber mats removed and 1 in place.

FIG. 8-5—Is with no rubber mats and is the same as FIG. 8.

DETAILED DESCRIPTION OF THE INVENITON

Figure 1:
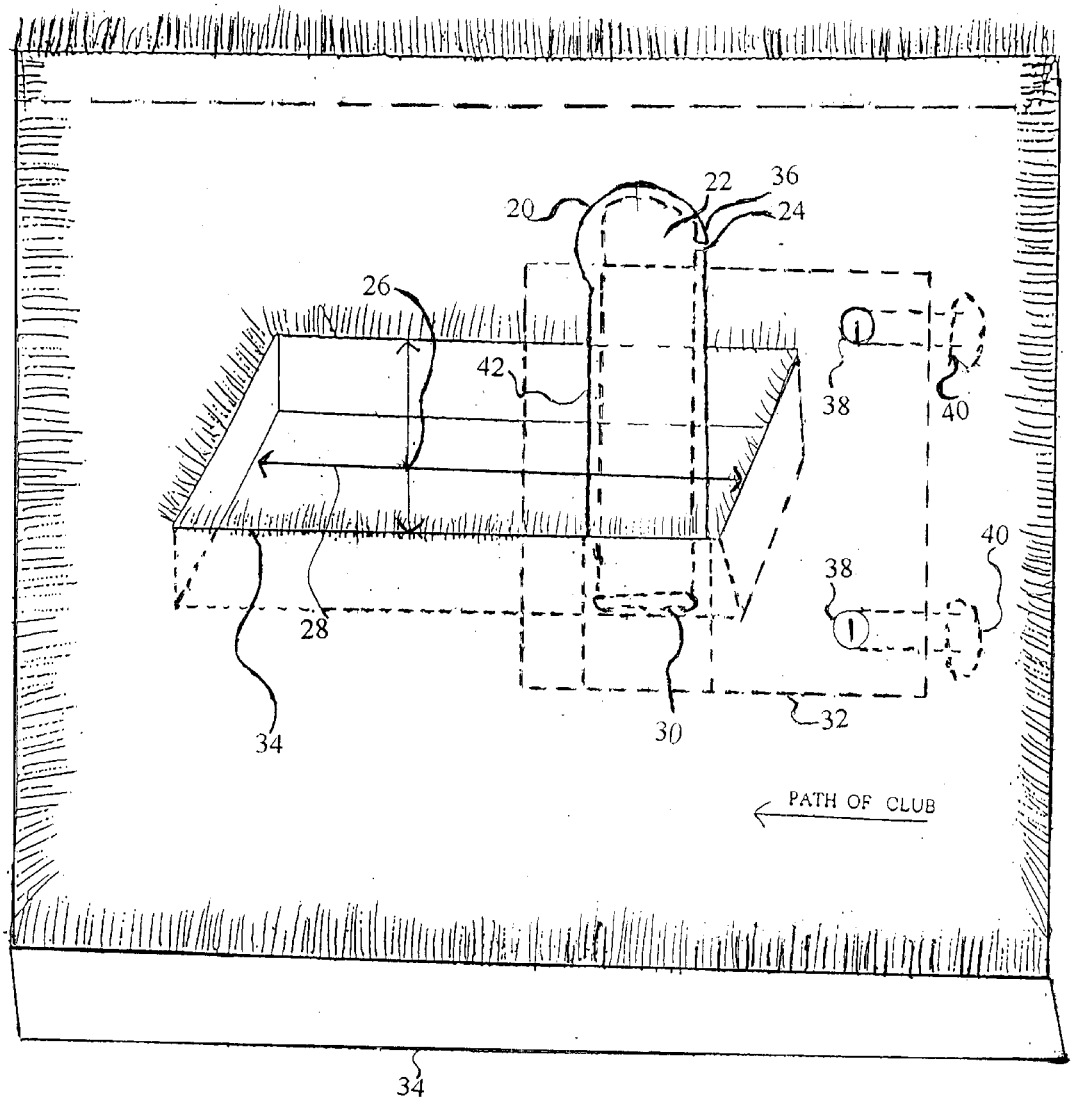
FIG. 1—This is a side view of a ball unit which is one piece, the ball shape, the stem and the pad which connects this unit to the hitting mat by the use of two nuts and two bolts placed about five inches apart.

Reference to FIG. 1 shows the completed format of this invention, minus the removable rubber mats. Starting at the bottom is the pad section 32 which holds the ball unit made up of three sections, the ball 36, the stem 42, and the pad 32, which is molded as one unit 20. The pad 32 is connected to the mat 34 by bolts 38 and nuts 40. The plug 30 holds material in the material chamber 22. The cut out area 26 of the mat 34 is utilized by accepting the ball 36 and stem 42 when it bends from the force of the swinging golf club. The orifice 24 faces the club head and material from chamber 22 is forced through this on to the club head at impact and bends to hit ground 28.

Figure 2:
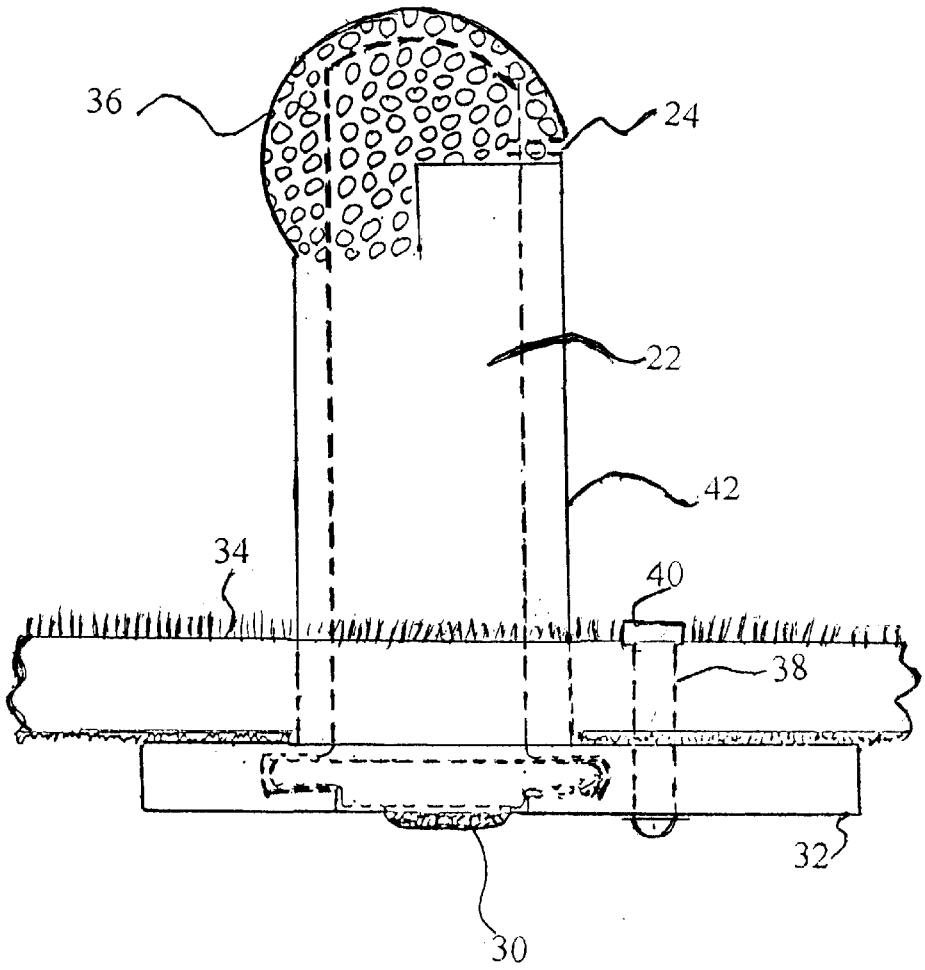
FIG. 2—Is a side view. The orifice faces the oncoming golf club. It is a ball unit attached to the mat.

Reference to FIG. 2 shows ball section 36 and its shape, with orifice 24, which expels material onto club face. The stem section 42 continues into the ball section 36, loosing one quarter of ball section 36 to form an extension of stem 42, in this area, to eliminate the undercuts normally formed by the contour of a ball. This ball unit 20 is connected to the mat 34 by one nut 40 and bolt 38 while the other is not shown.

Figure 3:
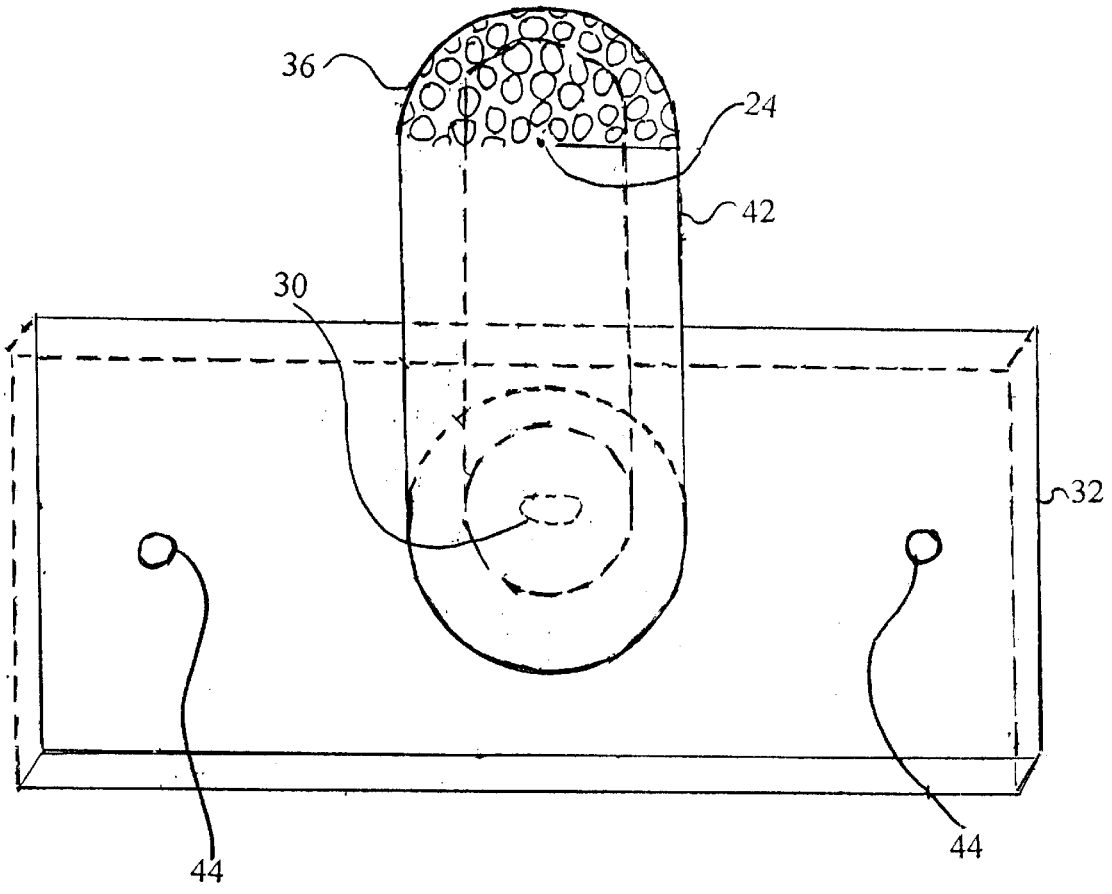
FIG. 3—Is a front view of the one-piece ball unit with the orifice facing the path of the club head. It has less ball shaped area due to merging and extending of the stem to the center of the ball.

FIG. 3 front view of ball unit shows length of stem 42 in this area with holes for bolt 44.

Figure 4:
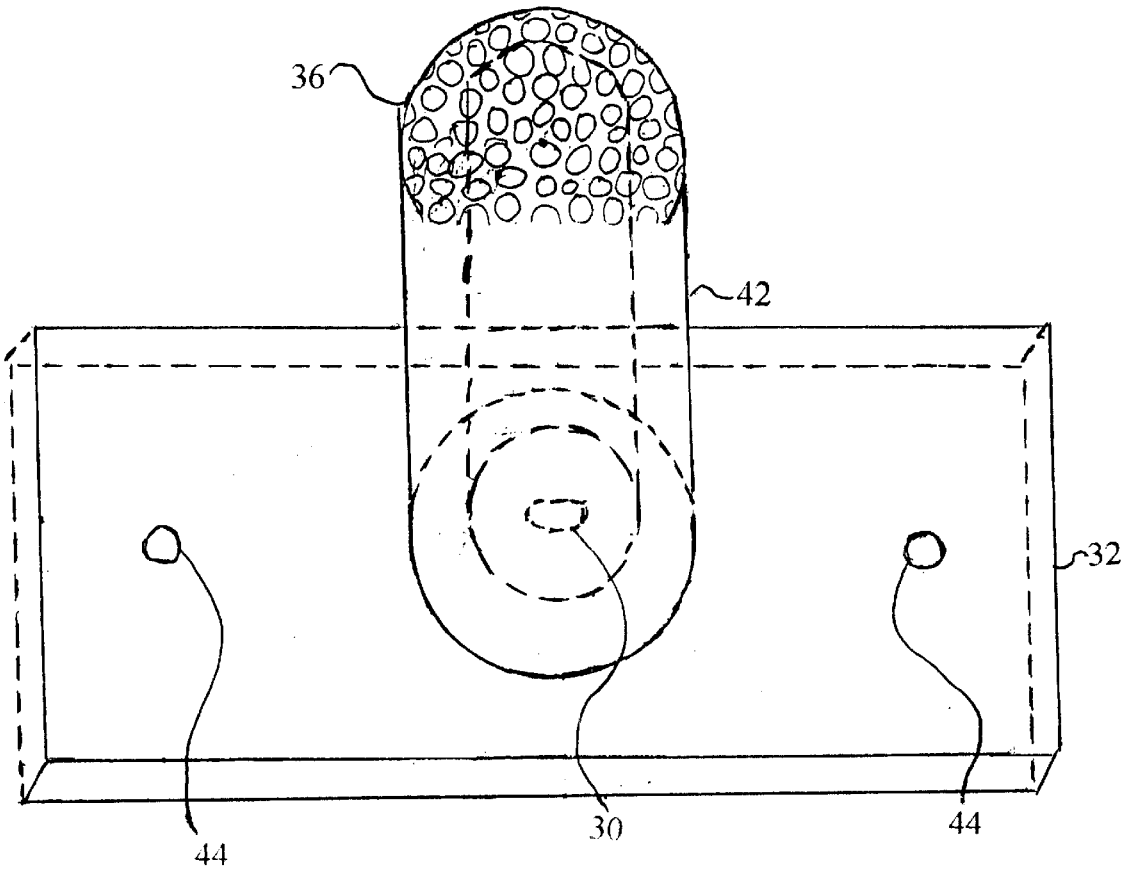
FIG. 4—Is a back view of the ball unit. There is not orifice here. More ball design as it goes past the center of part of ball before merging with the stem.

FIG. 4 back view of ball unit 20 with an increase in size of the contour of the ball 36 due to no need to cover undercut area.

Figure 5:
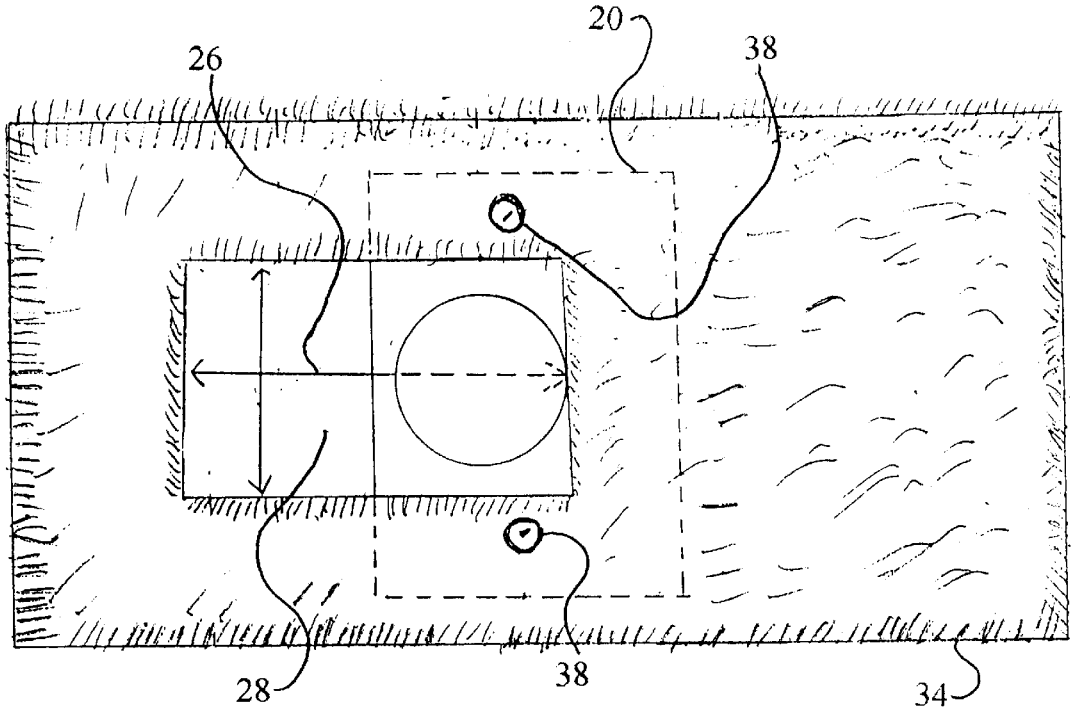
FIG. 5—Is the top view of the ball unit and mat.

FIG. 5 shows the top view of ball unit 20 and mat 34 with cut out area 26. Also 38 bolts that hold mat 34 and ball unit 20 together.

Figure 6:
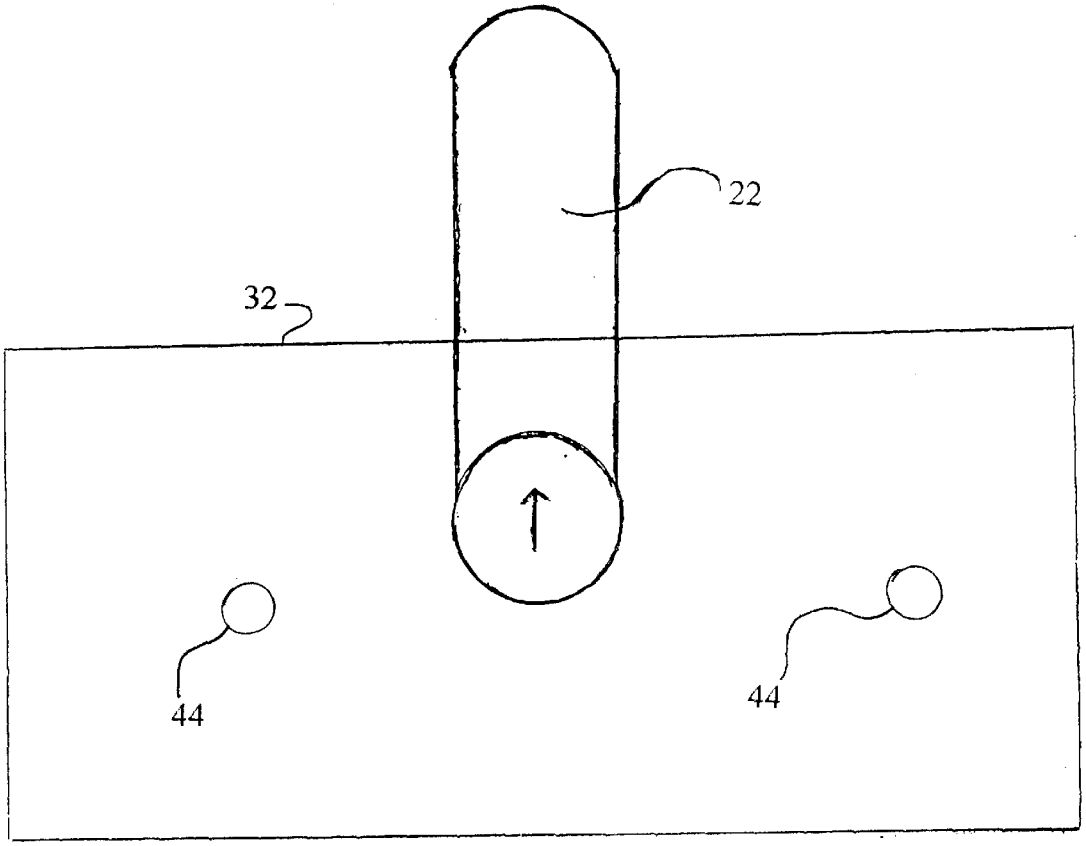
FIG. 6—Is the bottom view of ball assembly showing the bottom of the pad with no plug, looking down into the material chamber.

FIG. 6 bottom view of pad 32 looking into material chamber 22 with not plug 30. Has bolt holes 44.

Figure 7:
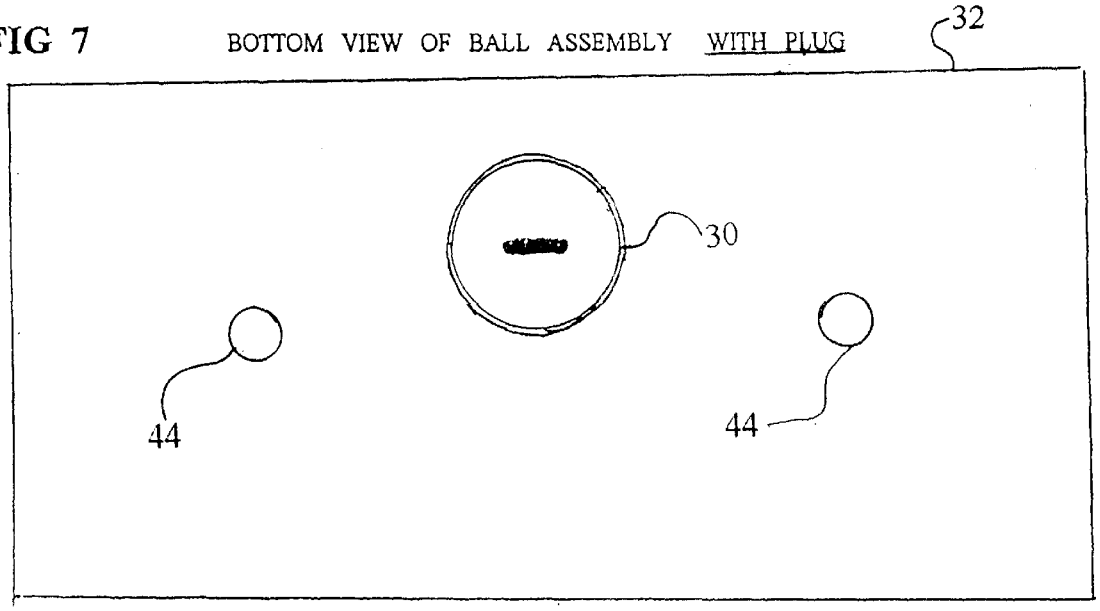
FIG. 7—Is bottom view of ball assembly showing plug in place.

FIG. 7 bottom view of pad 32 with plug 30 in place and shows holds for bolt 44.

Figure 8:
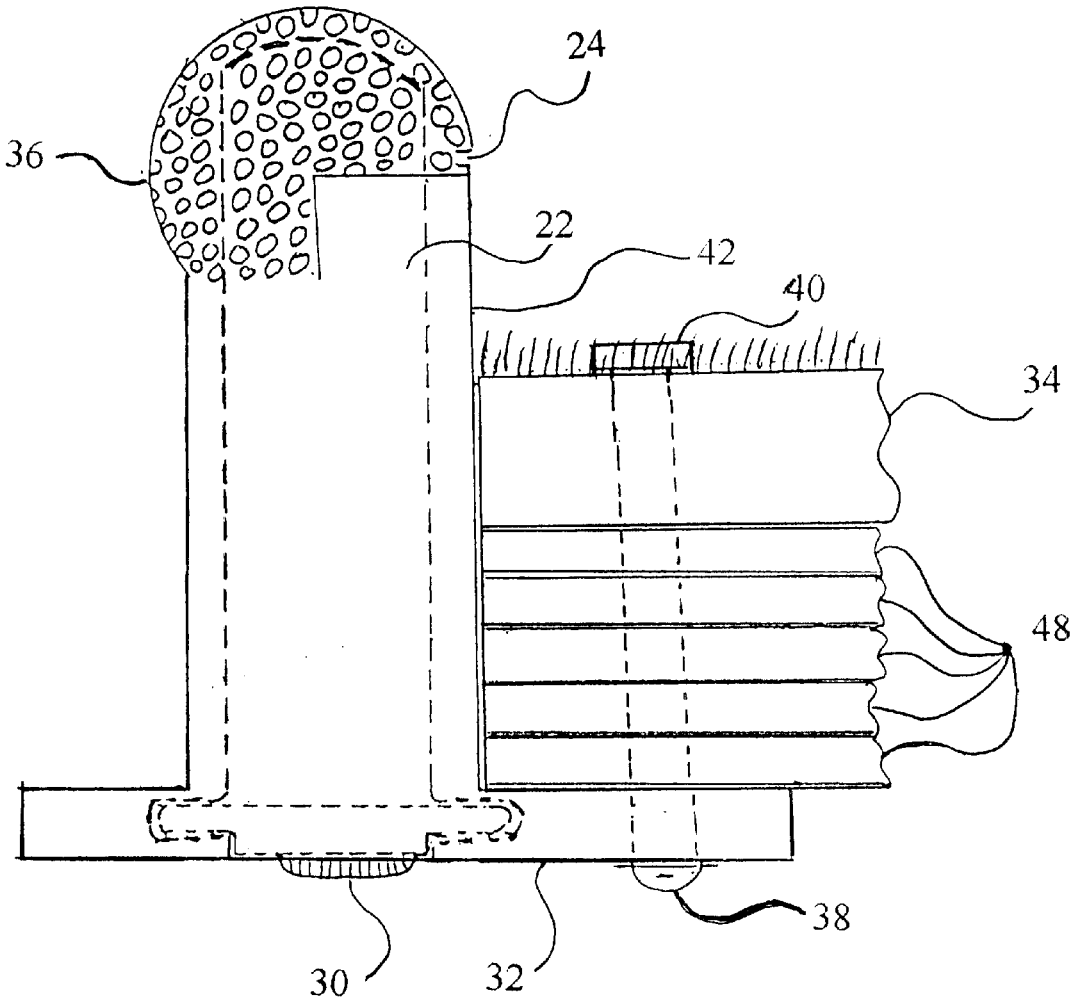
FIG. 8—Is first alternate version side view with five individual removable mats with hitting pad (astro turf) on top all bolted together.
Figures 1, 8:
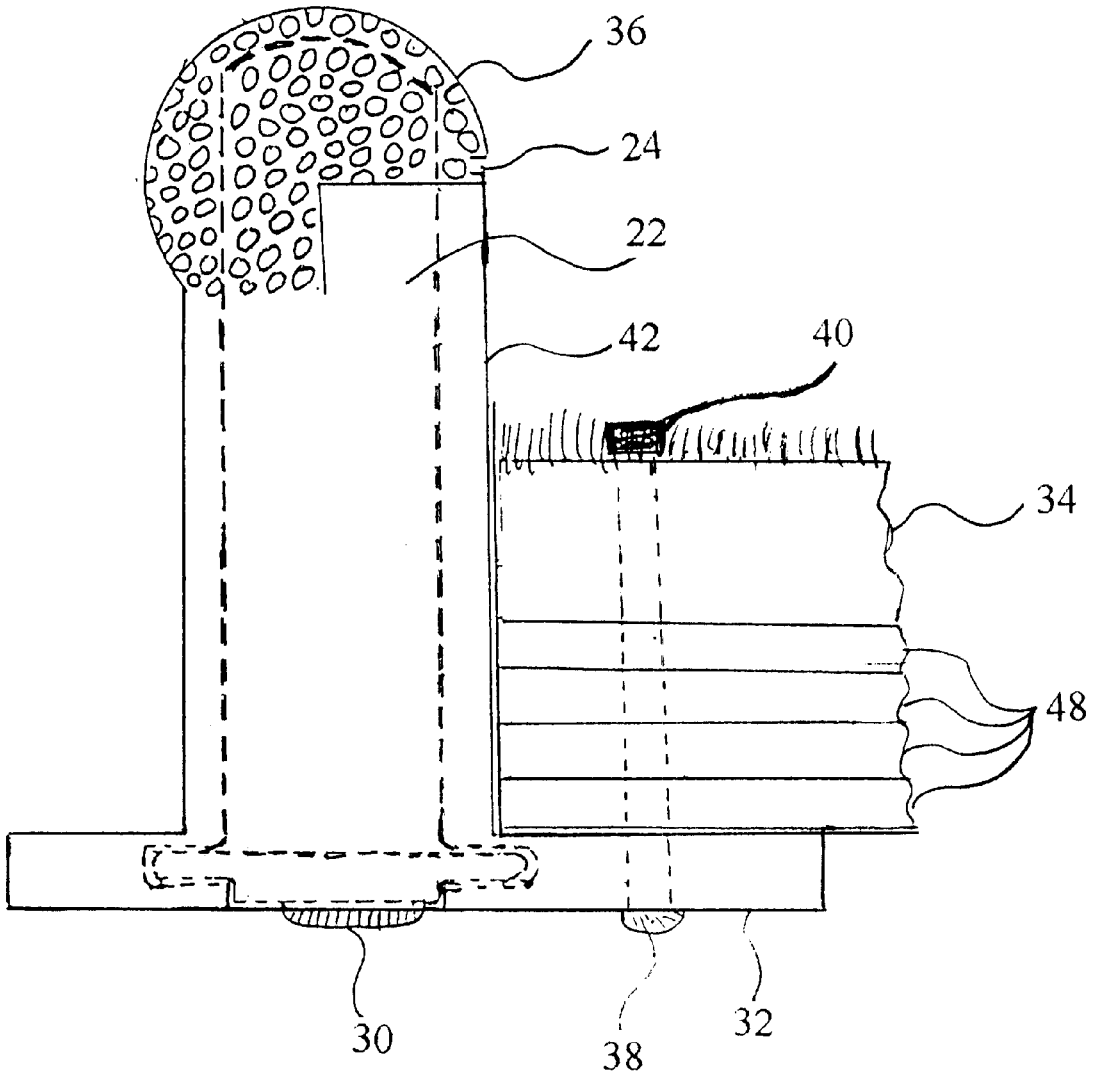
Figures 2, 8:
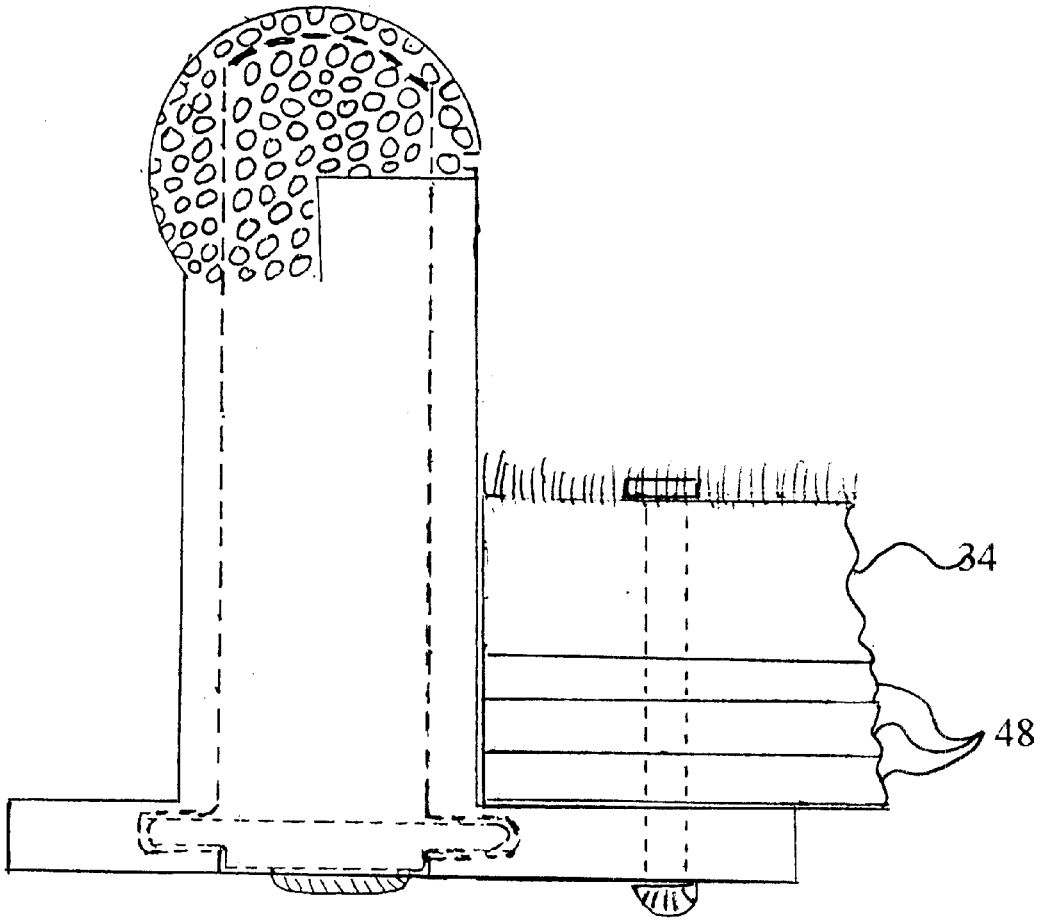
Figures 3, 8:
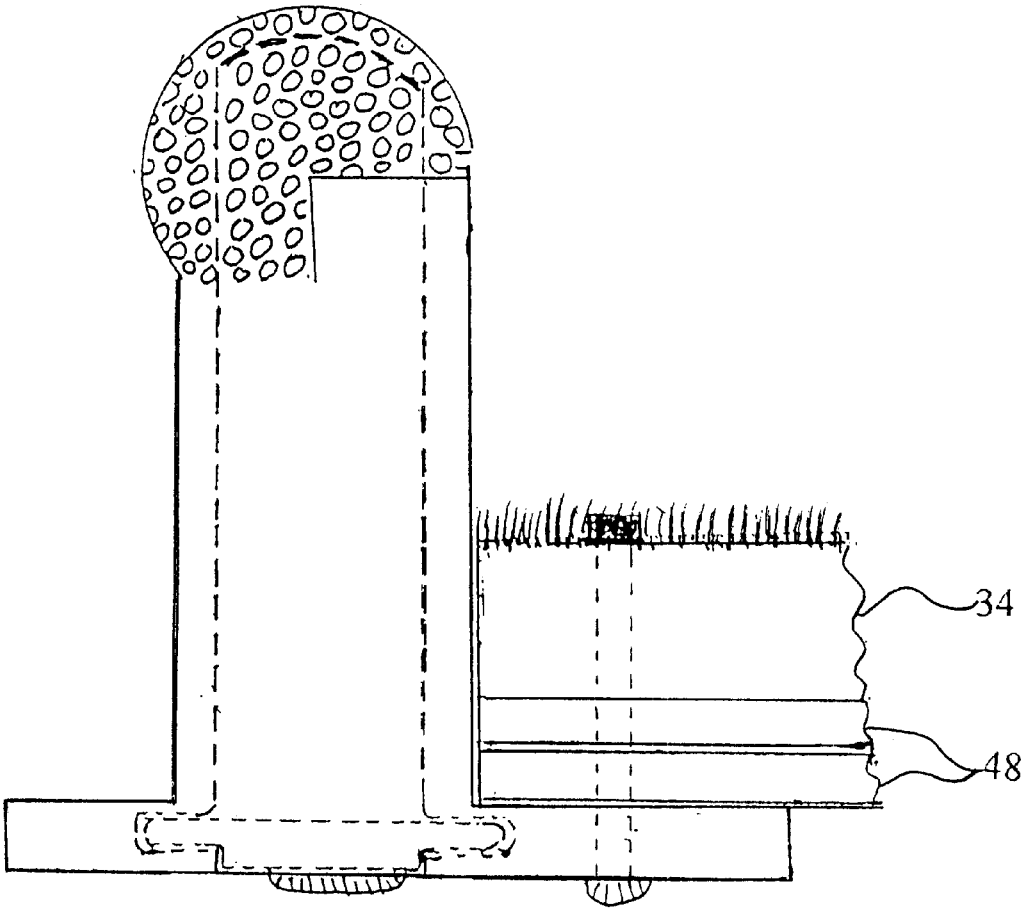
Figures 4, 8:
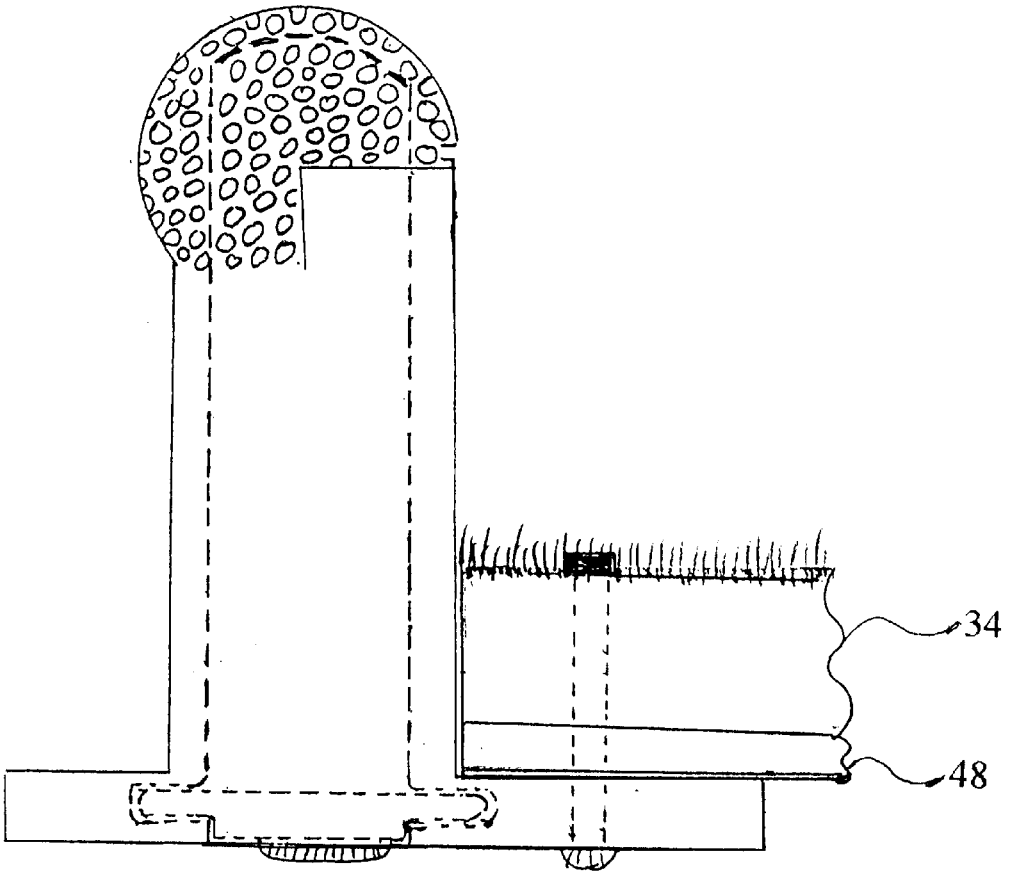
Figures 5, 8:
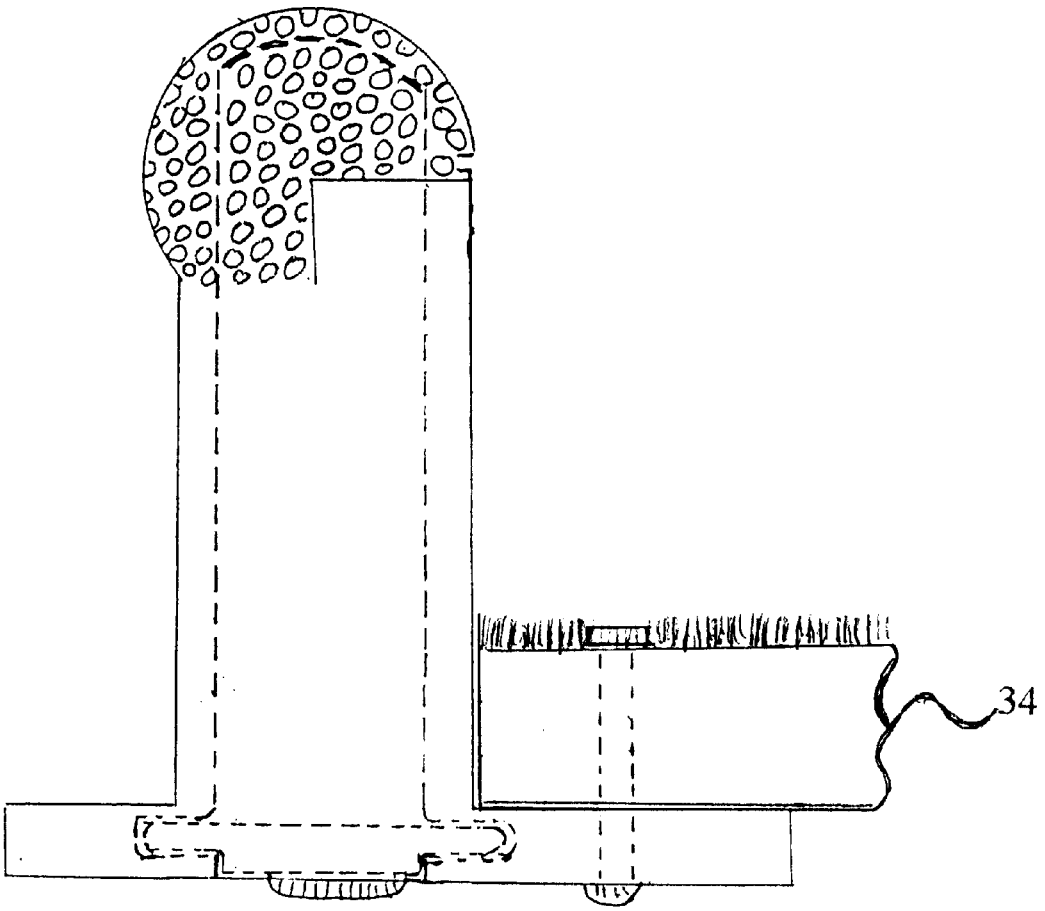

FIG. 8 is an alternate version that shows removable rubber mats 48 bolted 38 with nut 40 FIG. 8-1 through 8-4 show consecutively one less rubber mat 48 and FIG. 8-5 shows no rubber at all. When a rubber is removed it will show more ball unit 20 exposed over the mat 34 making for user to hit more or less of ball 36 with stem 42. This removal or adding rubber mat 48 will entertain the user to his ability.

Figure 9:
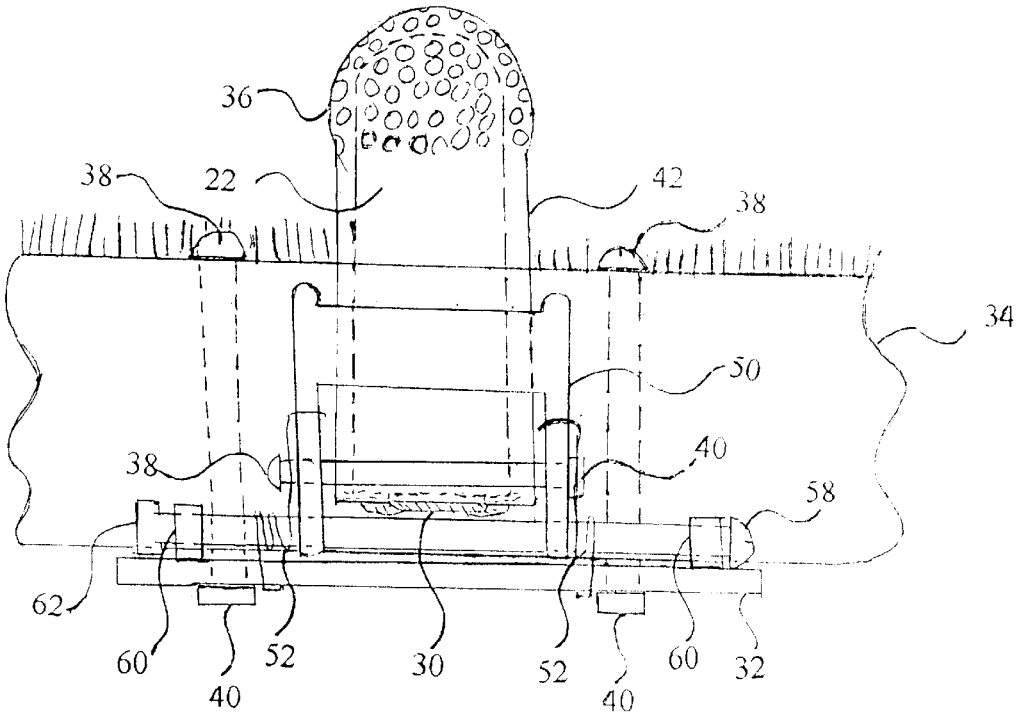
FIG. 9—Of a second alternate version with mechanical features showing the ball and stem as a one piece unit, a separate pad and a ball/stem that can be raised or lowered. The pad is connected to the ball holding units and the ball holding unit is housed on the bolt that connects the pad to the ball holding unit and allows it to be movable back and forth on this bolt.

FIG. 9 a second alternate version is mechanical in nature. It has a ball holder 50 which also houses a means to adjust the height of the ball stem exposed for hitting. This will be seen in FIG. 10. The pad 32 is separate from the ball 36 and stem 42 but ball 36 and stem 42 are one unit. The pad 32 connects the ball holder 50 by the use of a bolt 58 and nut 62. The ball 36 and stem 42 unity is held to the ball holder 50 by a bolt 38 and nut 40. Springs 52 on both sides of the ball holder 50 keep it upright as it rides down and up on bolt 58 and nut 60.

Figure 10:
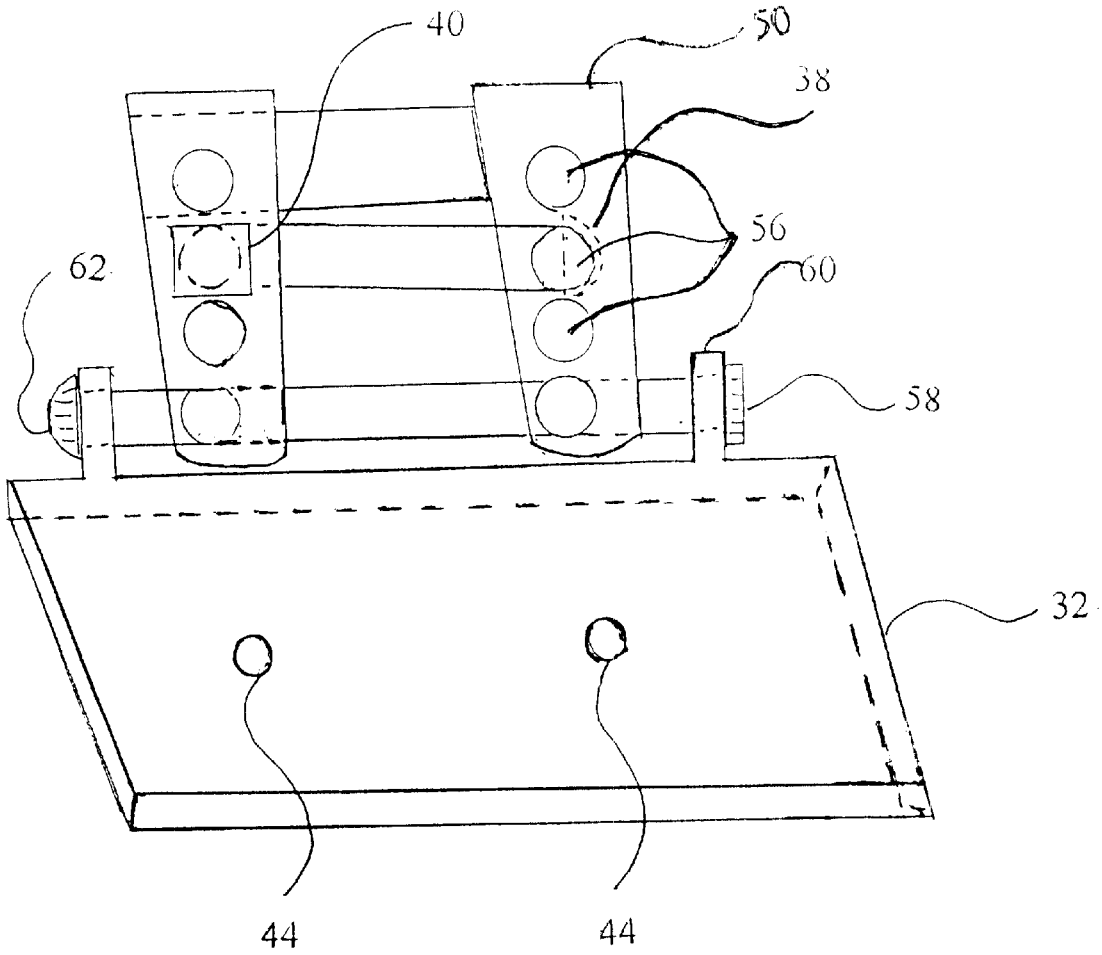
FIG. 10—Is the front view of ball hold and pad showing the main bolt that houses the ball holder and that the ball holder or stem and pad can be moved up or down.

FIG. 10 shows front view of ball holder 50 and pad 32. The ball 36 and stem 42 would be held by nut 40 and bolt 38. The pad 36 is held by bolt 62 and nut 58 and goes through part of pad 60. The ball holder rotates on bolt 62 and nut 58 and held by springs 58 not shown here but in FIG. 9. The ball 36 and stem can change positions by moving up and down on the provided holes 56 and bolted 38 and nut 40 tightly. Each position will extend or diminish the amount of ball 36 and stem 42 exposed for the used to hit.

I claim:

1. A golf training device for indicating proper impact between a golf club and a golf ball comprising:

a) a molded ball unit wherein said ball unit includes a golf ball having an orifice, a molded pad having means for supporting said golf ball in an upright position wherein said molded pad has an opening, means integrally connecting said golf ball to said molded pad, a material chamber housed within said ball unit for holding flowable marking material and connected to said orifice, a plug removably attached to said material chamber for accessing said material chamber through the opening of said molded pad, and flowable marking material within said material chamber b) a mat mounted to the molded pad of said ball unit wherein said mat includes an opening the thickness of said mat being such as to allow said ball and connecting means to pass thereby, wherein when said golf club impacts with said golf ball, marking material is ejected from the orifice of said ball onto the golf club indicating the point of impact and said ball and connecting means permits said ball to travel away from said club face upon impact.

2. The golf training device according to claim 1, wherein at least one rubber mat lies between the pad of said ball unit and said mat.

3. The golf training device according to claim 1, wherein a supporting means comprises a plurality of nuts and bolts.

4. The golf training device according to claim 1, wherein the support means further comprises:

a) a ball holder having a U-shaped configuration and sides connected to said molded pad for holding said ball and said connecting means, and b) at least two springs attached to the sides of the ball holder for holding said ball holder in an upright position, wherein said plurality of nuts and bolts are used for attaching said ball and connecting means to said ball holder and for attaching said ball holder to the molded pad of said ball unit.

* * * * *